US006024787A

United States Patent [19]

Lee

[11] Patent Number: 6,024,787

[45] Date of Patent: Feb. 15, 2000

[54] WATER SOLUBLE CERAMIC CORE FOR USE IN DIE CASTING, GRAVITY AND INVESTMENT CASTING OF ALUMINUM ALLOYS

[75] Inventor: Yuh-Wen Lee, Kaoshiong Hsien, Taiwan

[73] Assignee: Industrial Technology Research Institute, Hsinchu, Taiwan

[21] Appl. No.: 09/092,746

[22] Filed: Jun. 5, 1998

[51] Int. Cl.[7] ..... B22C 01/16; B22C 01/18

[52] U.S. Cl. ..... 106/38.22; 106/38.2; 106/38.23; 106/38.51; 164/522; 164/525; 164/369; 249/61; 501/107

[58] Field of Search ..... 106/38.2, 38.22, 106/38.23, 38.3, 38.35, 38.51, 38.27; 164/522, 525, 528, 529, 369; 249/61; 501/107

[56] References Cited

U.S. PATENT DOCUMENTS

| | | | |
|---|---|---|---|
| 1,531,871 | 3/1925 | Nagel | 106/38.51 |
| 3,551,365 | 12/1970 | Matalon | 106/38.51 |
| 4,391,642 | 7/1983 | Stevenson et al. | 106/38.23 |
| 4,438,804 | 3/1984 | Aiga et al. | 164/522 |
| 4,659,526 | 4/1987 | Shimaguchi et al. | 264/86 |
| 5,147,834 | 9/1992 | Banerjee | 106/38.27 |
| 5,743,953 | 4/1998 | Twardowska et al. | 106/38.35 |

*Primary Examiner*—Robert Davis
*Assistant Examiner*—Thukhanh T. Nguyen
*Attorney, Agent, or Firm*—W. Wayne Liauh

[57] ABSTRACT

A water-soluble ceramic core is prepared which can be advantageously used in the die casting, gravity casting, and investment casting of precision aluminum alloy objects. The ceramic core contains: (a) 60 to 70% by weight of alumina ($A1_2O_3$) flour; (b) about 15 to 25 by weight of zircon ($ZrSiO_4$) flour; (c) about 5 to 15 by weight of sodium hydrogen phosphate ($Na_2HPO_4$); and (d) about 5 by weight of sugar. In preparing the ceramic core, sodium hydrogen phosphate and sugar are first dissolved in water to form a sodium hydrogen phosphate/sugar solution. Then alumina flour and zircon flour are added into the sodium hydrogen phosphate/sugar solution to form a slurry, which is caused to form a precursory ceramic core using an injection molding or slip casting process. After blow-drying the precursory ceramic core is calcined at temperatures between 70 and 800° C. The ceramic core can be optionally immersed into a lacquer solution to impart a water-proof film on its surface, so as to allow it to withstand attacks from steam during autoclaving.

11 Claims, No Drawings

WATER SOLUBLE CERAMIC CORE FOR USE IN DIE CASTING, GRAVITY AND INVESTMENT CASTING OF ALUMINUM ALLOYS

FIELD OF THE INVENTION

The present invention relates to an improved water-soluble ceramic core for use in the various types of aluminum alloy casting processes such as die casting, gravity casting and investment casting. More specifically, the present invention relates to an improved water-soluble ceramic core typically formed using injection molding or slip casting which exhibits excellent water solubility, mechanical strength, surface smoothness, as well as other desirable properties. The water-soluble ceramic core of the present invention is most suitable for the die casting, gravity casting, and investment casting in making precision parts from aluminum alloys.

BACKGROUND OF THE INVENTION

With the advancement of complex precision parts that can be made from aluminum alloys, it becomes increasing likely that the conventional fabrication processes will not meet the new requirement. As a result, various casting processes are being increasingly utilized to fabricate precision aluminum alloy parts.

In the so-called investment casting process, a precise wax pattern is prepared corresponding to the metal article to be formed. Then the wax pattern is invested (i.e., coated) with particulate ceramic material so as to build up a ceramic shell mold with a desired thickness. If the article to be manufactured contains complex openings or cavities, such as deep holes, bent holes, under-cuts, etc., one or more of the so-called ceramic cores can be used which will be disposed in places where such openings or cavities are to be formed. When the wax pattern is subsequently removed from the ceramic shell mold, the ceramic cores will remain in place so as to form appropriate openings, cavities or the like in the final article to be cast. Ceramic cores can also be used in other casting processes such as die casting, gravity casting, etc.

After the metal casting is completed, the ceramic cores must be removed from the cast article. Typically, the ceramic cores can be readily removed by forming the cores from a material which is soluble in caustic alkali. However, this procedure cannot be used for aluminum alloy objects which are subject to chemical attacks by the caustic alkali. Several ceramic core materials have been developed which are soluble or at least disruptable in water so that, after the aluminum alloy objects are formed, the ceramic cores can be removed by the use of water. However, commercially available water-soluble ceramic cores often do not exhibit acceptable mechanical properties that will allow them to withstand the severe autoclave conditions when making aluminum alloy castings.

U.S. Pat. No. 4,572,272, the content thereof is incorporated herein by reference, disclosed a ceramic core made from alumina and other non-silica based ceramic materials which is made leachable in fused anhydrous caustic alkali by the addition to the core of a material containing a hydrogen donor group such as hydroxyl groups, hydrides, or chemically combined water. The ceramic core disclosed in the '272 patent solved the deformation problems experienced from those silica-based cores; however, it is not water-soluble. And the need to use caustic alkali to remove the ceramic core after casting can cause waste disposal problems.

U.S. Pat. No. 4,925,492, the content thereof is incorporated herein by reference, disclosed a fired ceramic core which can be rendered water disruptible under the steam autoclaving conditions in aluminum investment casting. The ceramic core disclosed in the '492 patent contains 20 to 50 wt % of water-soluble salts and inert ceramic fillers, and are vacuum impregnated with ethyl silicate and a cured phenolic resin. The ceramic core disclosed in the '492 patent provides improved resistance during steam autoclaving to remove the wax mold; however, its high salt content often caused instability in the dimension of the final products.

U.S. Pat. No. 5,460,854, the content thereof is incorporated herein by reference, disclosed a method of strengthening a fired porous ceramic core for use in investment casting including the step of impregnating a fired porous ceramic core with an aqueous solution of a strengthening agent such as water-soluble gum, resin, and sugar. Preferably, the strengthening agent is polyvinyl alcohol. However, because the strengthening agent is applied after the porous ceramic core is formed, it provides strengthening function only during the wax-injecting step. After the ceramic shell is formed, its strength would be weakened and the ceramic shell became brittle.

Because of the increasing importance of aluminum alloy based precision parts and the shortcomings of the currently available ceramic cores, it is highly desirable to devote significant research efforts to develop improved ceramic cores that can be advantageously employed for the casting of precision aluminum alloy parts.

SUMMARY OF THE INVENTION

The primary object of the present invention is to develop an improved water-soluble ceramic core for use in the fabrication of precision aluminum alloy parts by casting. More specifically, the primary object of the present invention is to develop an improved water-soluble ceramic core which will exhibit improved water solubility, mechanical strength, surface smoothness, as well as other desirable properties so as to allow aluminum alloy based precision parts to be fabricated using various casting techniques such as die casting, gravity casting, and investment casting, in a cost-effective and environmentally-friendly manner.

The improved ceramic core of the present invention is prepared from a composition containing about 60 to 70 wt % of alumina ($Al_2O_3$) flour, about 15 to 25 wt % zircon ($ZrSiO_4$) flour, about 5 to 15 wt % of sodium hydrogen phosphate ($Na_2HPO_4$), and about 5 wt % of cane sugar. Preferably, the ceramic core contains about 65 wt % of alumina flour, about 20 wt % zircon flour, about 10 wt % of sodium hydrogen phosphate, and about 5 wt % of cane sugar. In this composition, alumina ($Al_2O_3$) and zircon ($ZrSiO_4$) are used primarily as fillers, sodium hydrogen phosphate ($Na_2HPO_4$) mainly provides the function as a binding agent, and the addition of cane sugar improves the surface smoothness of the resultant water-soluble ceramic core as well as the separability from the injection mold. The presence of cane sugar also improves the wet strength of the ceramic core of the present invention.

In preparing the ceramic core according to a preferred embodiment of the present invention, distilled water, about 20 to 30 wt % of the total solid content of the ceramic core, is pre-heated to about 50° C., then sodium hydrogen phosphate (about 5 to 15 wt % of the total solid content), and cane sugar (about 5 wt %) are added which are then stirred until total dissolution. Thereafter, alumina flour (about 60 to 70 wt %, preferably at 200 mesh) and zircon flour (about 15 to 25 wt %, preferably at 120 mesh) are added to the sodium hydrogen phosphate/sugar solution. The mixture is then thoroughly stirred at elevated temperatures until a homogeneous ceramic slurry is obtained.

The ceramic slurry is then caused to form a precursory ceramic core using injection molding or slip casting. After dried, the precursory ceramic core is sanded and repaired for any cleavages and gas holes using the same slurry. Finally, the dried precursory ceramic core is calcined at various predetermined temperatures to form the final ceramic core. The ceramic core so prepared can be immersed in a lacquer solution to impart an outer layer of water-proof protection. The water-proof layer can protect the water-soluble ceramic core of the present invention from being adversely affected by steam during the removal of the wax pattern during investment casting process. With die casting or gravity casting, no water or steam will be encountered. Thus, the water-proofing step can be skipped in die casting or gravity casting.

DETAILED DESCRIPTION OF THE PREFERRED EMBODIMENT

The present invention discloses an improved water-soluble ceramic core for use in the fabrication of precision aluminum alloy parts by casting. The water-soluble ceramic core made from the process of the present invention has shown to exhibit improved water solubility, mechanical strength, surface smoothness, as well as other desirable properties so as to allow aluminum alloy based precision parts to be fabricated using various casting techniques such as die casting, gravity casting, and investment casting, in a cost-effective and environmentally-friendly manner.

The improved ceramic core of the present invention is prepared from a composition that contains about 60 to 70% by weight of alumina ($Al_2O_3$) flour, about 15 to 25 by weight of zircon ($ZrSiO_4$) flour, about 5 to 15 by weight of sodium hydrogen phosphate ($Na_2HPO_4$), and about 5 by weight of cane sugar. As discussed earlier, alumina ($Al_2O_3$) and zircon ($ZrSiO_4$) are used primarily as fillers, while sodium hydrogen phosphate ($Na_2HPO_4$) mainly provides the function as a binding agent, and the addition of cane sugar, among other things, improves the surface smoothness of the resultant water-soluble ceramic core as well as the separability from the injection mold. The presence of cane sugar also improves the wet strength of the water-soluble ceramic core of the present invention.

According to a preferred embodiment of the present invention, distilled water, about 20 to 30 wt % of the total solid content of the ceramic core, is pre-heated to about 50° C., then sodium hydrogen phosphate (about 5 to 15 wt % of the total solid content) and cane sugar (about 5 wt %) are added and the mixture solution is stirred until total dissolution. Thereafter, alumina flour (about 60 to 70 wt %, preferably at 200 mesh) and zircon flour (about 15 to 25 wt %, preferably at 120 mesh) are added to the sodium hydrogen phosphate/sugar solution. The mixture is then thoroughly stirred at elevated temperatures until a homogeneous ceramic slurry is obtained. The ceramic slurry is then caused to form a precursory ceramic core using injection molding or slip casting. After dried, the precursory ceramic core is sanded and repaired for any cleavages or gas holes using the same slurry or a freshly prepared slurry batch. Finally, the dried precursory ceramic core is heated at various predetermined temperatures to form the final ceramic core.

After it is finished, the ceramic core can be immersed in a lacquer solution to form a water-proof film on the surface thereof. During investment casting, the wax mold is often removed by steam heating. The water-proof film on the core surface protect the water-soluble ceramic core from dissolving or disruption during the steam wax removing process. The water-proofing step can be omitted if the ceramic cores are to be used in die casting or gravity casting, which does not involve water or steam.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

EXAMPLE 1

30 g of distilled water was heated to about 50° C. in a heating vessel, then 12 g of sodium hydrogen phosphate, and 5 g of cane sugar were added and the mixture was stirred until total dissolution. Thereafter, 80 g of alumina flour at 200 mesh and 25 g of zircon flour at 120 mesh were added to the sodium hydrogen phosphate/sugar solution. The mixture was then thoroughly stirred at 90° C. for 5 minutes to obtain a homogeneous ceramic slurry.

The ceramic slurry was then placed into the feed tube of an injection molding machine. A slip casting can also be used. The ceramic slurry was heated at 80° C. for 30 minutes to achieve a homogeneous temperature throughout the entire slurry. Because the slurry composition was selected such that its thermal expansion coefficient was less than 1.5/1000, the final cooled and solidified ceramic core had a high tendency to stick to the mold surface. The injection mold or slip casting mold, therefore, must comprise a relatively larger number of pieces so as to facilitate the separation of the ceramic core from the mold. Furthermore, a mold releasing agent containing 20% kerosine in paraffin wax can be used to buff the mold surface with the excess separating agent being wiped off from the surface, to further make the release of the precursory ceramic core from the injection mold easier. Silicone oil may also be used as a mold releasing agent.

After attaining its desired shape by injection molding, the precursory ceramic core was dried at room temperature for 24 hours. Thereafter, it was sanded and repaired using a freshly prepared slurry for any molding seams or cracks that may exist. After blow-dried at 50° C. for 4 hours and 70° C. for six hours, the dried precursory ceramic core was calcined at 200° C. for four hours to form the final ceramic core. The ceramic core prepared in Example 1 was tested for its modulus of rupture and water solubility. The test results, which are summarized in Table 1, show that the ceramic core of Example has a modulus of rupture of 34.3 kg/cm$^2$ and excellent water solubility.

EXAMPLES 2–5

The procedures in preparing ceramic cores in Examples 2–5 were similar to that in Example 1, excepted that the calcining temperatures were 70° C., 400° C., 600° C., and 800° C., respectively, and the calcining times were 6 hours, 2 hours, 2 hours, and 2 hours, respectively. The ceramic cores prepared in Examples 2–5 were tested for their modulus of rupture and water solubility. The test results are also summarized in Table 1. The measured moduli of rupture for the ceramic cores prepared in Examples 2–5 are 57.1 kg/cm$^2$, 6.5 kg/cm$^2$, 7.1 kg/cm$^2$, and 22.5 kg/cm$^2$, respectively.

TABLE 1

| Calcining Condition | Modulus of Rupture | Water Solubility |
|---|---|---|
| Example 1 | 34.3 kg/cm$^2$ | Excellent |
| Example 2 | 57.1 kg/cm$^2$ | Excellent |
| Example 3 | 6.5 kg/cm$^2$ | Excellent |
| Example 4 | 7.1 kg/cm$^2$ | Good |
| Example 5 | 22.5 kg/cm$^2$ | Fair, but water-disruptable |

Table 1 shows that the modulus of rupture can depend to a significant extent on the calcining condition. Generally, calcining at 70° C. for 6 hours provides the best modulus of rupture.

Table 1 also shows that the water solubility of the ceramic cores can also be affected by the calcining condition. The ceramic cores prepared in Examples 1 through 3 showed excellent solubility; whereas, the ceramic core prepared in Example 4 showed good solubility. These ceramic cores can be dissolved in water and can be easily removed after the aluminum alloy parts are cast. The ceramic core prepared in Example 5 showed only fair solubility. However, it can be easily disrupted after immersed in water.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A water-soluble ceramic core for use in the casting of aluminum alloy objects containing:

(a) 60 to 70% by weight of alumina ($Al_2O_3$) flour;

(b) about 15 to 25 by weight of zircon ($ZrSiO_4$) flour;

(c) about 5 to 15 by weight of sodium hydrogen phosphate ($Na_2HPO_4$); and (d) about 5 by weight of sugar.

2. The water-soluble ceramic core according to claim 1 which contains about 65 wt % of alumina flour.

3. The water-soluble ceramic core according to claim 1 which contains about 20 wt % of zircon flour.

4. The water-soluble ceramic core according to claim 1 which contains about 10 wt % of sodium hydrogen phosphate.

5. The water-soluble ceramic core according to claim 1 which contains a water-proof lacquer film on its surface.

6. The water-soluble ceramic core according to claim 1 which is first calcined at temperatures between 70 and 800° C.

7. The water-soluble ceramic core according to claim 1 which is prepared from a process comprising the following steps:

(a) dissolving said sodium hydrogen phosphate and said sugar in water to form a sodium hydrogen phosphate/sugar solution;

(b) adding said alumina flour and said zircon flour into said sodium hydrogen phosphate/sugar solution to form a slurry;

(c) forming a precursory ceramic core using injection molding or slip casting;

(d) blow-drying said precursory ceramic core; and (e) calcining said precursory ceramic core at temperatures between 70 and 800° C.

8. The water-soluble ceramic core according to claim 7 which further includes the step of sanding and repairing said precursory ceramic core after said precursory ceramic core is dried.

9. The water-soluble ceramic core according to claim 7 wherein said precursory ceramic core is calcined at 70° C. for about 6 hours.

10. The water-soluble ceramic core according to claim 7 wherein said precursory ceramic core is calcined at 800° C. for about 2 hours.

11. The water-soluble ceramic core according to claim 7 wherein said precursory ceramic core is calcined at 200° C. for about 4 hours.

* * * * *